US007650934B2

(12) United States Patent
Demuth et al.

(10) Patent No.: US 7,650,934 B2
(45) Date of Patent: Jan. 26, 2010

(54) HEAT EXCHANGER

(75) Inventors: Walter Demuth, Gerlingen (DE); Martin Kotsch, Ludwigsburg (DE); Karl-Heinz Staffa, Stuttgart (DE); Christoph Walter, Stuttgart (DE)

(73) Assignee: BEHR GmbH & Co., Stuttgart (DE)

( * ) Notice: Subject to any disclaimer, the term of this patent is extended or adjusted under 35 U.S.C. 154(b) by 126 days.

(21) Appl. No.: 10/496,001

(22) PCT Filed: Jul. 3, 2003

(86) PCT No.: PCT/EP03/07102

§ 371 (c)(1),
(2), (4) Date: May 27, 2004

(87) PCT Pub. No.: WO2004/005826

PCT Pub. Date: Jan. 15, 2004

(65) Prior Publication Data

US 2005/0006072 A1 Jan. 13, 2005

(30) Foreign Application Priority Data

Jul. 3, 2002 (DE) ..... 102 29 973

(51) Int. Cl.
*F28F 9/26* (2006.01)

(52) U.S. Cl. ..... 165/174; 165/176

(58) Field of Classification Search ..... 165/135, 165/174, 176

See application file for complete search history.

(56) References Cited

U.S. PATENT DOCUMENTS 3,835,920 A * 9/1974 Mondt ..... 165/81
4,660,626 A 4/1987 Valier
4,770,240 A * 9/1988 Dawson et al. ..... 165/176
5,314,013 A * 5/1994 Tanabe ..... 165/176
5,355,947 A 10/1994 Rasso, Jr. et al.
5,531,268 A * 7/1996 Hoshino et al. ..... 165/153
5,720,341 A * 2/1998 Watanabe et al. ..... 165/135
5,743,328 A * 4/1998 Sasaki et al. ..... 165/144
6,189,604 B1 2/2001 Yamauchi et al.
6,216,777 B1 4/2001 Rhodes et al.
6,523,606 B1 * 2/2003 Dienhart et al. ..... 165/144
6,789,613 B1 9/2004 Ozaki et al.
2003/0062152 A1 4/2003 Kuroda et al.
2003/0106677 A1 * 6/2003 Memory et al. ..... 165/135

(Continued)

FOREIGN PATENT DOCUMENTS

CN 1074526 C 11/2001

(Continued)

*Primary Examiner*—Allen J Flanigan
(74) *Attorney, Agent, or Firm*—Foley & Lardner LLP

(57) ABSTRACT

The invention relates to a heat exchanger, particularly a radiator for a heating or air conditioning unit in motor vehicles, which cools a coolant. Said heat exchanger (1) is penetrated by air, comprises collector pipes (S1, S2, S2, S4) and several essentially horizontally disposed pipes (5), and is divided into several partial blocks (T1, T2, T3, T4). The surfaces of the inventive partial blocks are selected according to the dimensions of structural space-related zones having different air temperatures inside the assembly space of the heat exchanger, the partial block which is first penetrated by the coolant being arranged within a structural space-related zone having a higher air temperature, preferably within the zone having the highest air temperature.

26 Claims, 5 Drawing Sheets

U.S. PATENT DOCUMENTS

2003/0183378 A1 * 10/2003 Memory et al. ..... 165/153

FOREIGN PATENT DOCUMENTS

| | | | | |
|---|---|---|---|---|
| DE | 100 01 628 | A1 | | 7/2000 |
| DE | 100 39 386 | A1 | | 2/2001 |
| EP | 0 414 433 | B1 | | 5/1995 |
| EP | 0 654 645 | A2 | | 5/1995 |
| EP | 0 845 648 | A2 | | 6/1998 |
| EP | 1 265 045 | A2 | | 12/2002 |
| JP | 4-115257 | U | | 10/1992 |
| JP | 7-146089 | A | | 6/1995 |
| JP | 11-325784 | A | | 11/1999 |
| JP | 2000-18880 | A | | 1/2000 |
| JP | 2001-099522 | A | | 4/2001 |
| JP | 2001-133192 | A | | 5/2001 |
| JP | 2001133192 | A | * | 5/2001 |
| JP | 2002-115991 | A | | 4/2002 |

* cited by examiner

HEAT EXCHANGER

BACKGROUND OF THE INVENTION

The invention relates to a heat exchanger, in particular a heat exchanger for a heating or air-conditioning system for motor vehicles in which a gaseous refrigerant is cooled by heat exchange contact with ambient air.

EP 0 845 648 A2 discloses a flat-tube heat exchanger, in particular a condenser of the serpentine type, with a flat-tube block consisting of one or more flat tubes which issue with preferably twisted end portions on the opposite or on the same tube block side into respective connection-space components, that is to say header tubes, so that, should the header tubes be arranged on the same tube block side, two header tubes running adjacently and parallel to one another are provided. In this case, a plurality of serpentine-shaped flat tubes may be provided, in which adjacent flat tubes are arranged with their inlet-side or their outlet-side tube portions adjacent to one another in the longitudinal direction of the header tubes, the serpentines comprising a plurality of 180° bends. A corresponding arrangement prevents heat transmission losses, but still leaves much to be desired.

EP 0 414 433 discloses a duplex heat exchanger which allows a coolant throughflow in cross countercurrent, in that two flat heat exchangers arranged one behind the other, designated hereafter as blocks, in each case with two header tubes which are connected to one another via a multiplicity of flat tubes, are provided. The two blocks are connected to one another by means of flanges and O-ring seals, for which purpose they have to be constructed, tensioned and soldered separately and, after soldering, connected to one another. The supply of the coolant to the block through which the flow passes first takes place in an upper region, the outlet at the bottom, and, in the second block through which the flow subsequently passes, inlet can take place both at the bottom and at the top, and outlet takes place correspondingly at the top or at the bottom. A duplex heat exchanger of this type which consists of two blocks entails a multiplicity of individual parts and a relatively high outlay in production terms, so that production is costly. Furthermore, a heat exchanger of this type still leaves much to be desired with regard to thermal properties.

Moreover, DE 100 43 439 A1 discloses a radiator for a supercritical steam compression refrigerating circuit, in which a coolant outlet is provided in a higher position than a coolant inlet, with respect to a vertical direction, such that coolant flows from an underside of the radiator to a top side, as a result of which an improvement in the cooling efficiency of the coolant is promised. Even a radiator of this type, however, still leaves much to be desired in terms of coolant efficiency.

SUMMARY OF THE INVENTION

The object of the invention is to improve a heat exchanger of the type initially mentioned.

The main idea of the invention is to make the surfaces of the subblocks dependent on the size of installation-space-related zones having different air temperatures and to cause coolant to flow first through the subblock within an installation-space-related zone having a higher air temperature, the subblock being arranged preferably within the zone having the highest air temperature.

In an advantageous embodiment of the heat exchanger, the height of the subblock through which coolant flows first is at least as great as the height of the zone having an increased air temperature.

In a further advantageous embodiment of the heat exchanger, the number of tubes arranged in the horizontal direction in a subblock is dependent on the installation-space-related air temperature zone within which the corresponding subblock is arranged.

In a particularly advantageous embodiment of the invention, the number of tubes of a subblock within a zone having a higher temperature is larger than the number of tubes of a subblock which is arranged within a zone having a lower temperature, the ratio of the number of tubes of the subblock within the zone having a higher temperature to the number of tubes of the subblock within the zone having a lower temperature being selectable in the range of 1:1 to 3:1.

In a particularly advantageous embodiment of the invention, at least two subblocks are arranged one behind the other and at least two subblocks are arranged one above the other, the coolant flowing through the subblocks in succession, and the order of throughflow being predeterminable, as desired, by means of structural measures.

Preferably, the coolant flows through at least two of the subblocks in countercurrent to the airstream.

In a particularly advantageous embodiment, the heat exchanger is subdivided into four subblocks through which the flow passes in succession, the subblocks through which the flow passes first being arranged below the subblocks through which the flow subsequently passes, the first and the second subblock and also the third and the fourth subblock being arranged in each case at the same height. Such a heat exchanger is suitable, in particular, for an installation space in which, as a consequence of installation space, there is in a lower region of the installation space a zone having a higher air temperature than in an upper region.

In an alternative version of the heat exchanger, the subblocks through which the flow passes first are arranged above the subblocks through which the flow subsequently passes, the first and the second subblock and also the third and the fourth subblock being arranged in each case at the same height. This alternative version of the heat exchanger is suitable, in particular, for an installation space in which, as a consequence of installation space, there is in an upper region of the installation space a zone having a higher air temperature than in a lower region.

The temperature of the coolant in the various subblocks differs as a function of the zones having different temperature. Thus, in an embodiment of the heat exchanger which is arranged in an installation space in which there is in a lower region of the installation space a zone having a higher air temperature than in an upper region, the temperature of the coolant is higher in the lower subblocks than in the upper subblocks, the temperature of one or of both rear subblocks being higher than the temperature of the corresponding front subblock. In an alternative embodiment of the heat exchanger which is arranged in an installation space in which there is in an upper region of the installation space a zone having a higher air temperature than in a lower region, the temperature of the coolant is higher in the upper subblocks than in the lower subblocks, the temperature of one or of both rear subblocks being higher than the temperature of the corresponding front subblock.

In all the instances mentioned, for example, R 134a and carbon dioxide may be used as coolant. In particular, carbon dioxide in a supercritical state, that is to say when there is a pure gas flow in the heat exchanger, is suitable for a heat exchanger according to the invention.

Preferably, a throughflow of at least two of the four subblocks by coolant takes place in cross countercurrent to the air. More effective heat transmission occurs as a result of cross countercurrent operation.

In particular, a diagonal deflection is provided between the second subblock and the third subblock, so that cross countercurrent operation takes place in all the subblocks.

Preferably, the diagonal deflection is formed by means of a one-part transition flange which is connected to two header tubes, to be precise to the header tube assigned to the second subblock and to the header tube assigned to the third subblock.

Preferably, in the region of the diagonal deflection, a tube, in particular a flat tube, is provided, through which coolant does not flow or flows to only a minimal extent, with the result that a decoupling of heat transmission takes place.

Preferably, the tubes which connect the header tubes and in the region of which heat transfer takes place are formed by flat tubes, the flat tubes being twisted through 90° upstream and downstream of a 180° bending point in the vicinity of the header tubes and on that side of the heat exchanger which is located opposite the header tubes.

In a further embodiment, the subblocks are closed off on both sides by means of header tubes, in which case at least two subregions may also be closed off on at least one side by means of a common header tube.

Preferably, the air flowing through the heat exchanger comes into contact with two or more regions of different temperature, the maximum air temperature difference between air inlet and air outlet being smaller than one and a half times the temperature difference between coolant inlet and coolant outlet, the coolant used being carbon dioxide in the supercritical state. In this case, temperatures of around 150° C. prevail at the coolant inlet and of around 50° C. at the outlet.

Preferably, the tubes arranged essentially in the horizontal direction are thermally separated from one another, for example by means of an air gap.

Preferably, the individual subblocks, too, are thermally separated from one another.

Preferably, the header tubes, too, are decoupled essentially thermally. There is thermal contact only at the diagonal deflection and, depending on design, also at the connecting flanges.

Preferably, the cooling ribs arranged between the tubes are likewise decoupled thermally. This is achieved, for example, by each subblock having its own cooling ribs.

BRIEF DESCRIPTION OF THE DRAWINGS

The invention is explained in detail hereafter by means of an exemplary embodiment, with reference to the drawings, in which.

DETAILED DESCRIPTION OF THE INVENTION

Figure 1:
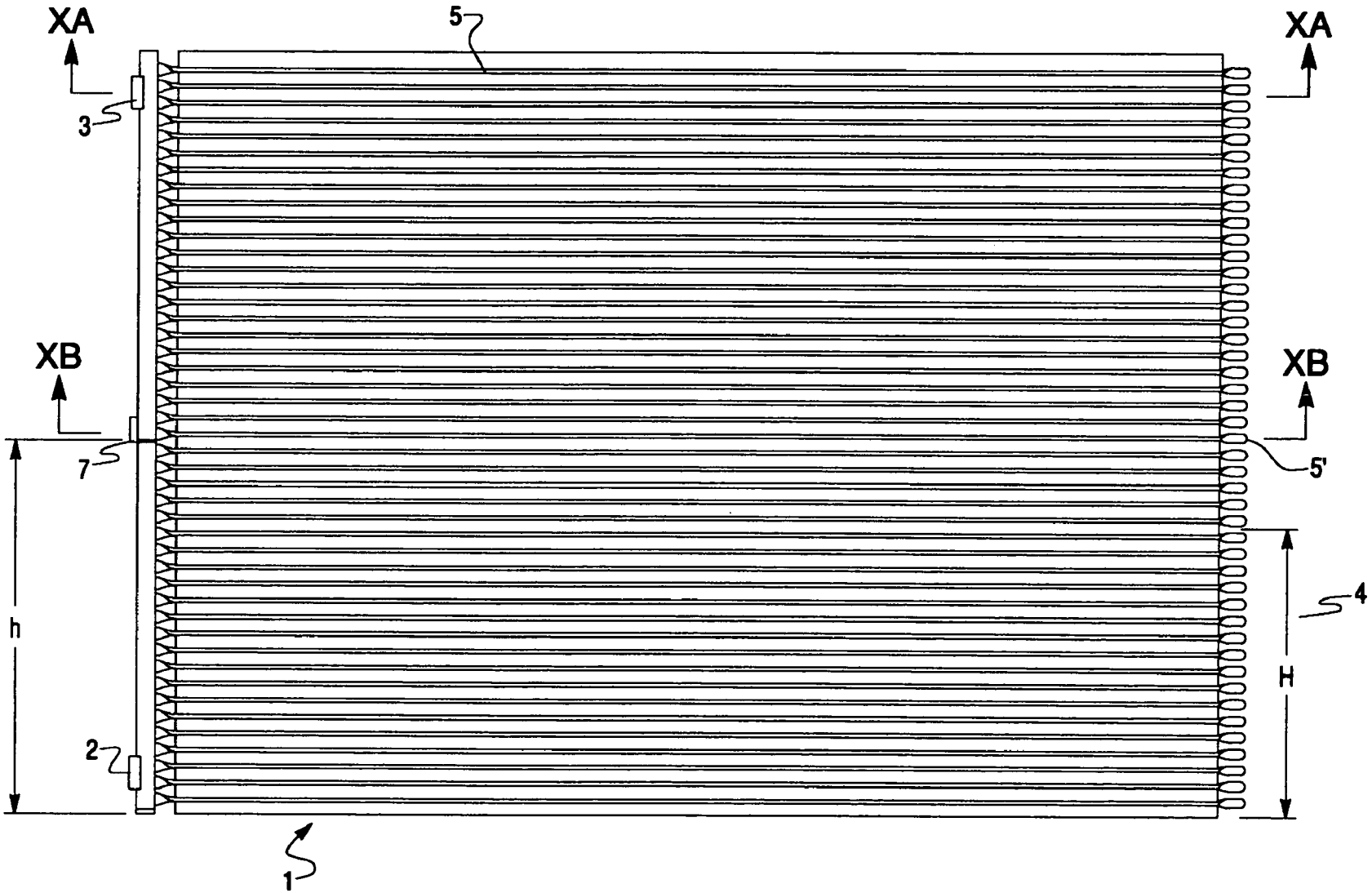
FIG. 1 shows a front view of a flat-tube heat exchanger according to the exemplary embodiment.
Figure 2:
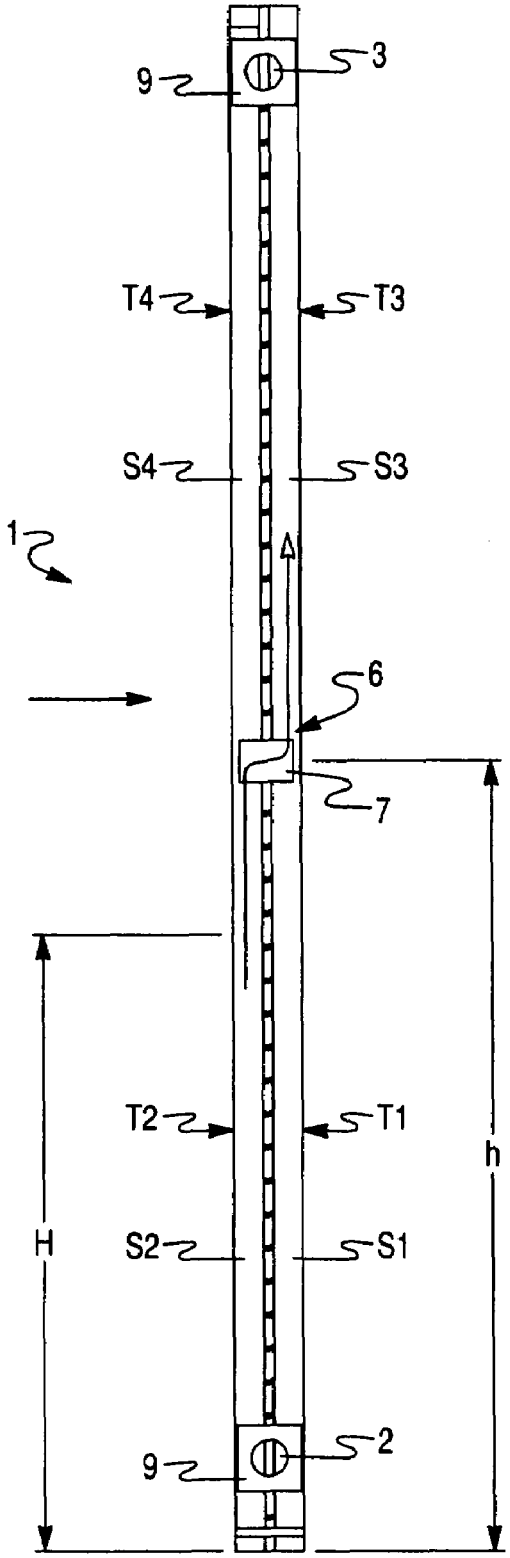
FIG. 2 shows a section through the flat-tube heat exchanger of FIG. 1 along the line II-II in FIG. 1.
Figure 3:
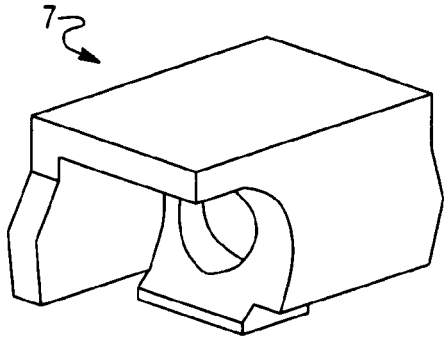
FIGS. 3 to 6 show a transition flange in various views.
Figure 5:
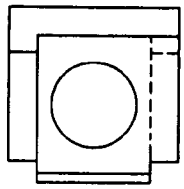
Figure 6:
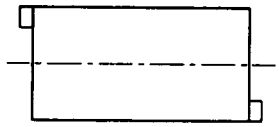
Figure 4:
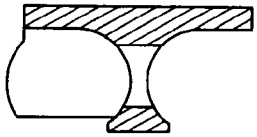
Figure 8:
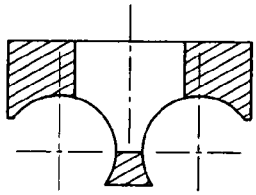
FIGS. 7 to 9 show a connection piece in various views.
Figure 7:
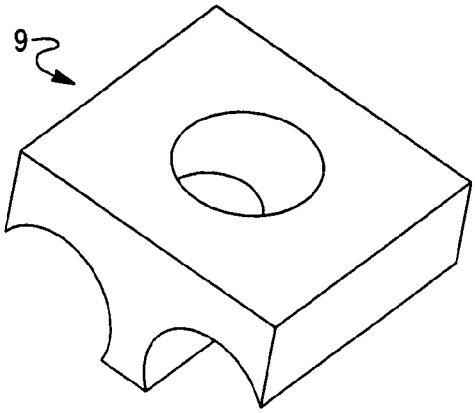
Figure 9:
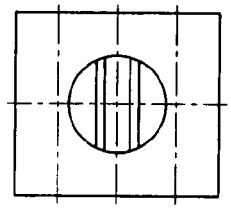

FIGS. 1 and 2 show a flat-tube heat exchanger for a heating or air-conditioning system of a motor vehicle, which serves as a radiator 1 and is part of a coolant circuit, not illustrated, and which serves for cooling a coolant, in particular $CO_2$, with the aid of the air flowing through the radiator 1. FIG. 2 illustrates the airstream symbolically by an arrow pointing to the radiator 1 from the left. The $CO_2$ is normally in a supercritical state as a pure gas flow, temperatures of around 150° C. prevailing at the inlet 2 into the radiator 1. A cooling of the coolant takes place in the radiator 1, so that temperatures of around 50° C. prevail at the outlet 3.

Figure 10A:
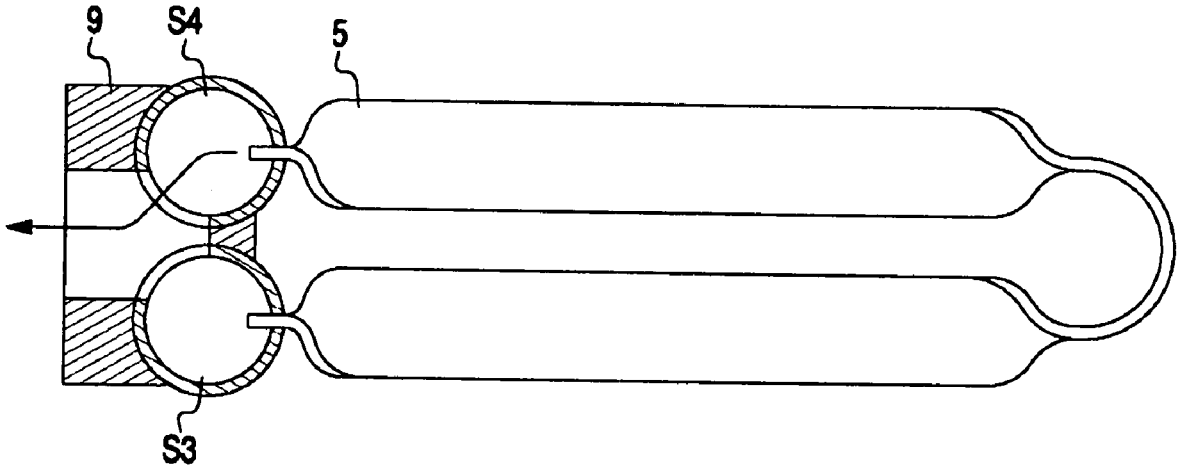
FIGS. 10A to 10B show the cross sections of the flat tube heat exchanger along the line XA-XA and the line XB-XB in FIG. 1, respectively.
Figure 10B:
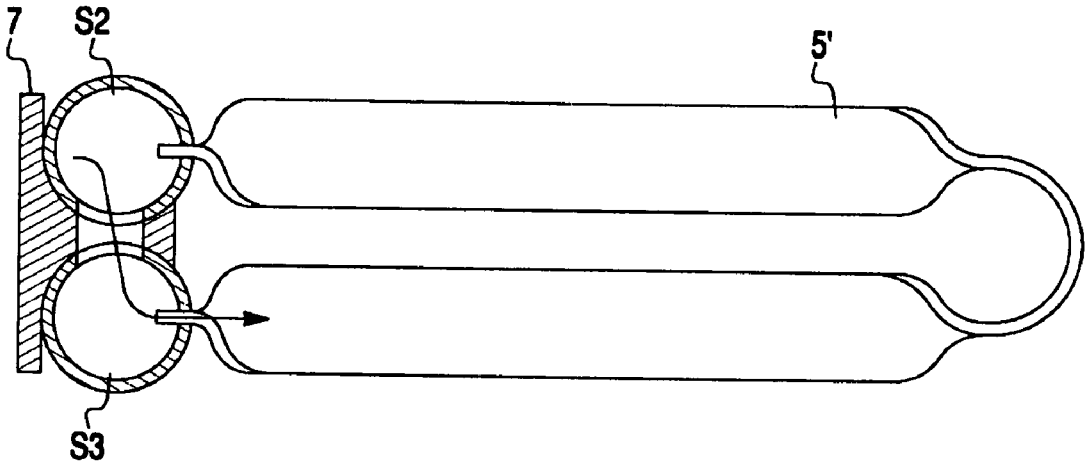
Figure 11:
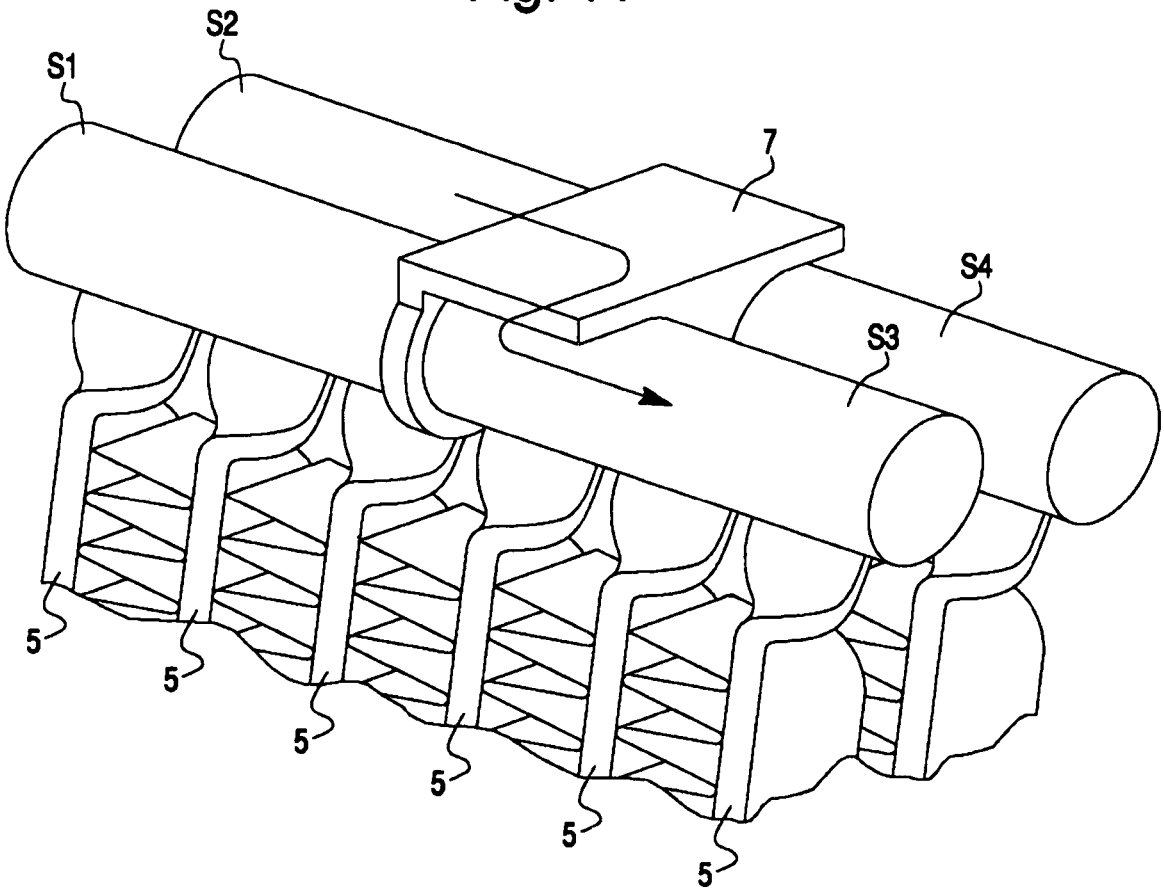
FIG. 11 shows a partial perspective view of the flat tube heat exchanger showing the transition flange.

In order to allow an optimum utilization of the air flowing through the radiator 1, the radiator 1 is subdivided into 2×2 subblocks which are designated hereafter as T1, T2, T3 and T4. In this case, in the installed state, the subblocks T1 and T2 are arranged within a zone 4 having a higher air temperature and below the subblocks T3 and T4. The height h of the two subblocks T1, T2 which are arranged within the zone 4 having the higher air temperature is greater than the height H of the zone 4 having an increased air temperature, the value of the air temperature in the zone 4 being higher than the air temperature in the remaining regions of the installation space of the radiator 1. A header tube S1, S2, S3, S4 is connected to each subblock, in each case two header tubes S1, S2 and S3, S4 being arranged at the corresponding height of the subblocks T1, T2 and T3, T4. Between the header tubes S1, S2 and S3, S4 are arranged a plurality of flat tubes 5, through which the coolant can pass from one header tube S1 or S3 to the adjacent header tube S2 or S4, for which purpose the flat tubes 5 have a U-shaped run. They are twisted in each case through 90° in a known way in the vicinity of the respective header tube S1, S2, S3, S4, as seen in FIGS. 10A, 10B, and 11. Between the flat tubes 5 are arranged ribs (see FIG. 11) which assist the heat exchange, and these ribs may be divided in two, that is to say the subblocks T1, T2 and T3 , T4 arranged one behind the other have in each case their own ribs. It is also possible, however, to decouple the ribs of the subblocks thermally by means of slots.

So that the coolant can flow through the radiator 1 in cross countercurrent to the air, a diagonal flow deflection 6 from subblock T2 to subblock T3 is provided, as is indicated in FIG. 2 by an arrow depicted into the radiator 1. For this purpose, a transition flange 7, as is illustrated in FIGS. 3 to 6, 10B, and 11, is provided between the two header tubes S2 and S3, the zone of the flat tube 5' lying at the boundary of the two subblocks T2, T3 being utilized, in that the partitions of the two header tubes S2 and S3 are mounted so as to be offset by the amount of one transverse division. The middle flat tube 5' is thus "short-circuited" and has scarcely any flow passing through it, at the most as a result of a slight pressure difference which occurs between the two header tubes S2 and S3 on account of the slight throttling effect in the transition flange 7. In this case, the flat tube 5' through which no flow or only a minimal flow passes has the secondary effect that thermal decoupling is achieved between the subblocks T1, T3 and T2, T4. The transition flange 7 is conventionally produced, together with the two partitions, as one component and is also soldered during the soldering of the radiator 1.

The header tubes S1 and S2 or S3 and S4 are connected to one another in each case at the inlet 2 or at the outlet 3 via a connection piece 9, as is illustrated in FIGS. 7 to 9 and 10A, so that coolant can also pass directly into the header tube S2 or can flow directly out of the header tube S3.

For thermal decoupling, the collection of the coolant takes place, after the latter has flowed through the subblocks T1 and T2 or T3 and T4, in header tubes S1, S3 and S2, S4 designed separately. The thermal coupling of the subblocks T1 and T2 or T3 and T4 via the one-part ribs may be reduced by the slotting of the rib or by any other suitable measure.

According to the exemplary embodiment illustrated, there is a division of the subblocks T1, T2 in relation to the subblocks T3, T4 of 50:50, but the division should preferably be made decreasingly, that is to say, for example, 60:40 or 70:30, since, as in the condenser, the outlet density is higher and consequently the volume of flow lower than at the inlet. Moreover, the gas radiator likewise serves in a subcritical state as a condenser.

List of Reference Symbols

1 Radiator
2 Inlet
3 Outlet
4 Zone having a higher temperature
5, 5' Flat tube
6 Diagonal reversal
7 Transition flange
9 Connection piece
S, S2, S3, S4 Header tube
T1, T2, T3, T4 Subblock
H Height of the zone having a higher temperature
h Subblock height

The invention claimed is:

1. A heat exchanger for cooling refrigerant by an air stream flowing therethrough in a flow direction, comprising:

a plurality of header tubes comprising two inlet header tubes and two outlet header tubes;

a plurality of tubes arranged essentially in a horizontal direction;

an inlet for the refrigerant, wherein the inlet is connected to the two inlet header tubes such that the refrigerant is configured to pass into both of the two inlet header tubes;

an outlet for the refrigerant, wherein the outlet is connected to the two outlet header tubes such that the refrigerant is configured to pass out of both of the two outlet header tubes; and a diagonal flow deflection member, wherein the heat exchanger is subdivided into a plurality of subblocks of said tubes, wherein each subblock is in fluid communication with a corresponding header tube, wherein each of the subblocks has a frontal area facing said flow direction that has a size that is preselected dependent on sizes of regions having different air temperatures, wherein the subblock through which refrigerant flows first after said inlet is arranged within a region having a higher air temperature than at least one other region, and wherein the diagonal flow deflection member is located between the respective headers of two subblocks, for diagonally transmitting flow from an upstream subblock to a subsequent subblock displaced in the downstream direction with respect to the upstream subblock.

2. The heat exchanger as claimed in claim 1, wherein the region having a higher air temperature is a region having the highest air temperature.

3. The heat exchanger as claimed in claim 1, wherein a height of the subblock through which refrigerant flows first is at least as great as a height of said region having a higher air temperature.

4. The heat exchanger as claimed in claim 1, wherein a number of tubes arranged in the horizontal direction in a subblock is dependent on the size of the air temperature region within which the corresponding subblock is arranged.

5. The heat exchanger as claimed in claim 4, wherein a ratio of a number of tubes of a first subblock to a number of tubes of a second block is in a range of 1:1 to 3:1.

6. The heat exchanger as claimed in claim 1, wherein at least two subblocks are arranged one behind the other and at least two subblocks are arranged one above the other, the refrigerant flows through the subblocks in succession.

7. The heat exchanger as claimed in claim 6, wherein the refrigerant flows through at least two of the subblocks in countercurrent flow with respect to the air stream.

8. The heat exchanger as claimed in claim 1, wherein the refrigerant flows through at least two of four subblocks in cross countercurrent flow with respect to the air.

9. he heat exchanger as claimed in claim 1, wherein the diagonal flow deflection member comprises a one-part transition flange which is connected to the respective header tubes of the two subblocks.

10. The heat exchanger as claimed in claim 9, wherein the transition flange has partitions for the header tubes.

11. The heat exchanger as claimed in claim 10, wherein the transition flange has a passage which forms a connection between the two header tubes.

12. The heat exchanger as claimed in claim 1, wherein at least one of the inlet and the outlet comprises a connection piece which is connected to two header tubes.

13. The heat exchanger as claimed in claim 12, wherein the connection piece has a partition.

14. The heat exchanger as claimed in claim 1, wherein the tubes are flat tubes that are twisted in each case through 90° in the vicinity of the respective header tube to which each is connected.

15. The heat exchanger as claimed in claim 14, wherein the flat tubes are twisted through 90° upstream and downstream of a 180° bending point on a side of the heat exchanger which is located opposite the header tubes.

16. The heat exchanger as claimed in claim 1, wherein the air flowing through the heat exchanger comes into contact with two or more regions of different temperature, wherein a maximum air temperature difference between an air inlet and an air outlet is lower than one and a half times a temperature difference between the refrigerant inlet and the refrigerant outlet, wherein the refrigerant used is carbon dioxide in a supercritical state.

17. The heat exchanger as claimed in claim 1, wherein the tubes arranged essentially in the horizontal direction are thermally separated from one another.

18. The heat exchanger as claimed in claim 1, wherein the header tubes are decoupled essentially thermally from one another.

19. The heat exchanger as claimed in claim 1, wherein cooling fins are arranged between the tubes, and wherein the cooling fins of the individual subblocks are decoupled thermally.

20. The heat exchanger as claimed in claim 1, wherein there are four subblocks arranged for refrigerant to flow through the subblocks in succession, wherein the two subblocks through which the flow is configured to pass first are arranged below the two other subblocks through which the flow is configured to subsequently pass, and wherein the first two subblocks and the second two subblocks are respectively arranged at a same height.

21. The heat exchanger as claimed in claim 1, wherein there are four subblocks arranged for refrigerant to flow through the subblocks in succession, wherein the two subblocks through which the flow is configured to pass first are arranged above the two other subblocks through which the flow is configured to subsequently pass, and wherein the first two subblocks and the second two subblocks are respectively arranged at a same height.

22. The heat exchanger as claimed in claim 1, wherein the plurality of subblocks comprises two lower subblocks and two upper subblocks, wherein one lower subblock and one upper subblock form two front subblocks and the other lower subblock and the other upper subblock form two rear subblocks, and wherein the refrigerant has a temperature that is higher in the lower subblocks than in the upper subblocks, and the refrigerant has a temperature of one of the rear subblocks that is higher than the temperature of the refrigerant in its corresponding front subblock.

23. The heat exchanger as claimed in claim 1, wherein the plurality of subblocks comprises two lower subblocks and two upper subblocks, wherein one lower subblock and one upper subblock form two front subblocks and the other lower subblock and the other upper subblock form two rear subblocks, and wherein the refrigerant has a temperature that is lower in the lower subblocks than in the upper subblocks, and the refrigerant has a temperature of one of the rear subblocks that is higher than the temperature of the refrigerant in its corresponding front subblock.

24. A heat exchanger for cooling a refrigerant by an air stream flowing therethrough in a flow direction, the heat exchanger comprising:

a plurality of header tubes comprising two inlet header tubes and two outlet header tubes;

a plurality of tubes arranged essentially in a horizontal direction;

an inlet for the refrigerant, wherein the inlet is connected to the two inlet header tubes such that the refrigerant is configured to pass into both of the two inlet header tubes; and an outlet for the refrigerant, wherein the outlet is connected to the two outlet header tubes such that the refrigerant is configured to pass out of both of the two outlet header tubes, wherein the heat exchanger is subdivided into a plurality of subblocks of said tubes, wherein each subblock is in fluid communication with a corresponding header tube, wherein two sets of U-shaped tubes form four of said subblocks, and each of said two inlet header tubes and two outlet header tubes is located on the same side of its respective subblock, and wherein the heat exchanger further comprises a diagonal deflection member provided between two subblocks comprising a one-part transition flange which is connected to said four header tubes.

25. The heat exchanger as claimed in claim 24, wherein the transition flange comprises partitions for the header tubes and two cylindrical recesses running parallel to one another and spaced apart from one another.

26. The heat exchanger as claimed in claim 24, wherein, in the region of the diagonal deflection, at least one tube is provided, through which refrigerant does not substantially flow.

* * * * *